US007248002B2

(12) United States Patent
Yamamoto et al.

(10) Patent No.: US 7,248,002 B2
(45) Date of Patent: Jul. 24, 2007

(54) LIGHT EMISSION CONTROL APPARATUS AND LIGHT EMISSION CONTROL METHOD WITH TEMPERATURE-SENSITIVE DRIVING CURRENT CONTROL

(75) Inventors: Isao Yamamoto, Kyoto (JP); Yoichi Tamegai, Kyoto (JP)

(73) Assignee: Rohm Co., Ltd. (JP)

( * ) Notice: Subject to any disclaimer, the term of this patent is extended or adjusted under 35 U.S.C. 154(b) by 198 days.

(21) Appl. No.: 10/969,628

(22) Filed: Oct. 20, 2004

(65) Prior Publication Data

US 2005/0082553 A1 Apr. 21, 2005

(30) Foreign Application Priority Data

Oct. 21, 2003 (JP) ..... 2003-361169

(51) Int. Cl.
*G05F 1/00* (2006.01)

(52) U.S. Cl. ..... 315/308; 315/291; 315/307

(58) Field of Classification Search ..... 315/307–309, 315/291, 112–118, 209 R, 224, 276; 257/83; 345/82, 84, 90, 101
See application file for complete search history.

(56) References Cited

U.S. PATENT DOCUMENTS 5,024,535 A * 6/1991 Winston, Jr. ..... 374/178
6,963,175 B2 * 11/2005 Archenhold et al. ..... 315/291
7,176,640 B2 * 2/2007 Tagawa ..... 315/308
7,183,727 B2 * 2/2007 Ferguson et al. ..... 315/308
2004/0245941 A1 * 12/2004 Schrodinger ..... 315/291
2005/0088102 A1 * 4/2005 Ferguson et al. ..... 315/149
2005/0151489 A1 * 7/2005 Lys et al. ..... 315/308

FOREIGN PATENT DOCUMENTS

JP 2002-064223 2/2002
JP 2003-46132 2/2003

OTHER PUBLICATIONS

Japanese Office Action for Patent Application No. 2003-361169 with English translation dated Nov. 14, 2006.
Japanese Office Action for Patent Application No. 2003-361169 with English translation dated Nov. 14, 2006.
Office Action for Application No. 2003-361169 dated Feb. 27, 2007.

* cited by examiner

*Primary Examiner*—Trinh Dinh
*Assistant Examiner*—Tung Le
(74) *Attorney, Agent, or Firm*—Cantor Colburn LLP

(57) ABSTRACT

A temperature profile storage unit stores a Vf-Ta table showing a relationship between a forward voltage Vf and am ambient temperature Ta of an LED element, and a Ta-Ifmax table showing a relationship between the ambient temperature Ta and a maximum tolerable current Ifmax. The forward voltage Vf of the LED element driven by a power supply is detected and fed to a feedback point determining unit. A temperature computing unit determines the ambient temperature from the detected forward voltage Vf. A driving current determining unit determines a maximum tolerable current Ifmax from the ambient temperature Ta thus determined, by referring to the Ta-Ifmax table, and supplies a command value defining a current to drive the LED element to a constant current source via a D/A converter. The constant current source adjusts the current to drive the LED element in accordance with the command value.

19 Claims, 7 Drawing Sheets

| If | Vf | Ta |
|---|---|---|
| 1mA | 2. 2V | 25℃ |
| | 1. 5V | 75℃ |
| 10mA | 5V | 25℃ |
| | 4V | 50℃ |
| | 3V | 75℃ |

| Ta | I fmax | Vf |
|---|---|---|
| 25°C | 15mA | 4V |
| 50°C | 10mA | 4V |
| 75°C | 5mA | 4V |

LIGHT EMISSION CONTROL APPARATUS AND LIGHT EMISSION CONTROL METHOD WITH TEMPERATURE-SENSITIVE DRIVING CURRENT CONTROL

BACKGROUND OF THE INVENTION

1. Field of the Invention

The present invention generally relates to a light emission control technology and, more particularly, to a light emission control apparatus and a light emission control method for controlling the quantity of light emission by adjusting a current for driving a light emitting element.

2. Description of the Related Art

The light-emitting diode (LED) element is used for a variety of purposes in battery-driven portable equipment such as a portable telephone and a personal data assistant. For example, LED elements are used to provide backlight of a liquid crystal display or a flash light of a charge-coupled device (CCD) camera. LED elements producing difference colors may be operated to blink so as to provide illumination.

Characteristically, the quantity of light emitted by an LED element is increased in proportion to a current. The light emission efficiency depends on the temperature of the LED element. As the element temperature is increased as a result of an increase in the current, the light emission efficiency abruptly drops due to heat generated. When the element temperature goes higher than specifications, optical output is prevented from being increased even if the current is increased further. The driving current of some ultra-high luminance LED elements exceeds 100 mA so that the optical output drops significantly due to thermal resistance. In order to overcome this problem, study is being undertaken to produce an LED element of high-intensity light emission with special provisions for heat dissipation.

As described, it is necessary to take into account the problem with heat in controlling the light mission of an LED element. Japanese Laid-Open Patent Application 2002-64223 discloses a driving circuit which is provided with a temperature detecting means for detecting the temperature of a semiconductor light-emitting element such as an LED and which uses an output of the temperature detecting means to control a driving current of the light-emitting element.

The driving circuit of the related art requires a temperature sensor for detecting the ambient temperature of a light-emitting element so that the cost of manufacturing the driving circuit is increased.

Related Art List

JPA laid open 2002-64223.

SUMMARY OF THE INVENTION

The present invention is achieved in view of the above-described circumstances and has an objective of providing a light-emission control apparatus and a light-emission control method capable of adjusting the driving current at an appropriate level in consideration of heat generated by the light-emitting element.

One mode of practicing the present invention is a light emission control apparatus. The light emission control apparatus comprises: a temperature profile storage unit storing a table mapping forward voltages to ambient temperatures at discrete levels of the forward currents, showing characteristics of the ambient temperature with respect to the forward voltage of a light emitting element; a forward voltage detecting unit detecting the forward voltage of the light emitting element subject to control; a temperature computing unit determining the ambient temperature from the detected forward voltage, by referring to the table mapping the forward voltages to the ambient temperatures; a driving current determining unit determining a command value defining a driving current to drive the light emitting element in accordance with the ambient temperature determined by the temperature computing unit; and a driving current control unit controlling the driving current to drive the light emitting element in accordance with the command value thus determined. With this construction, it is possible to control the quantity of emitted light by adjusting the driving current within a range in which the light emitting element is operable.

Another mode of practicing the present invention is a light emission control method. The method comprises: detecting a forward voltage of a light emitting element; determining an ambient temperature of the light emitting element from the detected forward voltage, by referring to a table mapping the forward voltages to the ambient temperatures showing characteristics of the ambient temperature with respect to the forward voltage of a light emitting element; and determining a feedback point of a driving current to drive the light emitting element in accordance with the ambient temperature thus determined so as to control the driving current to drive the light emitting element accordingly.

Optional combinations of the aforementioned constituting elements, and implementations of the invention in the form of methods, apparatuses and systems may also be practiced as additional modes of the present invention.

DETAILED DESCRIPTION OF THE INVENTION

FIRST EMBODIMENT

Figure 1:
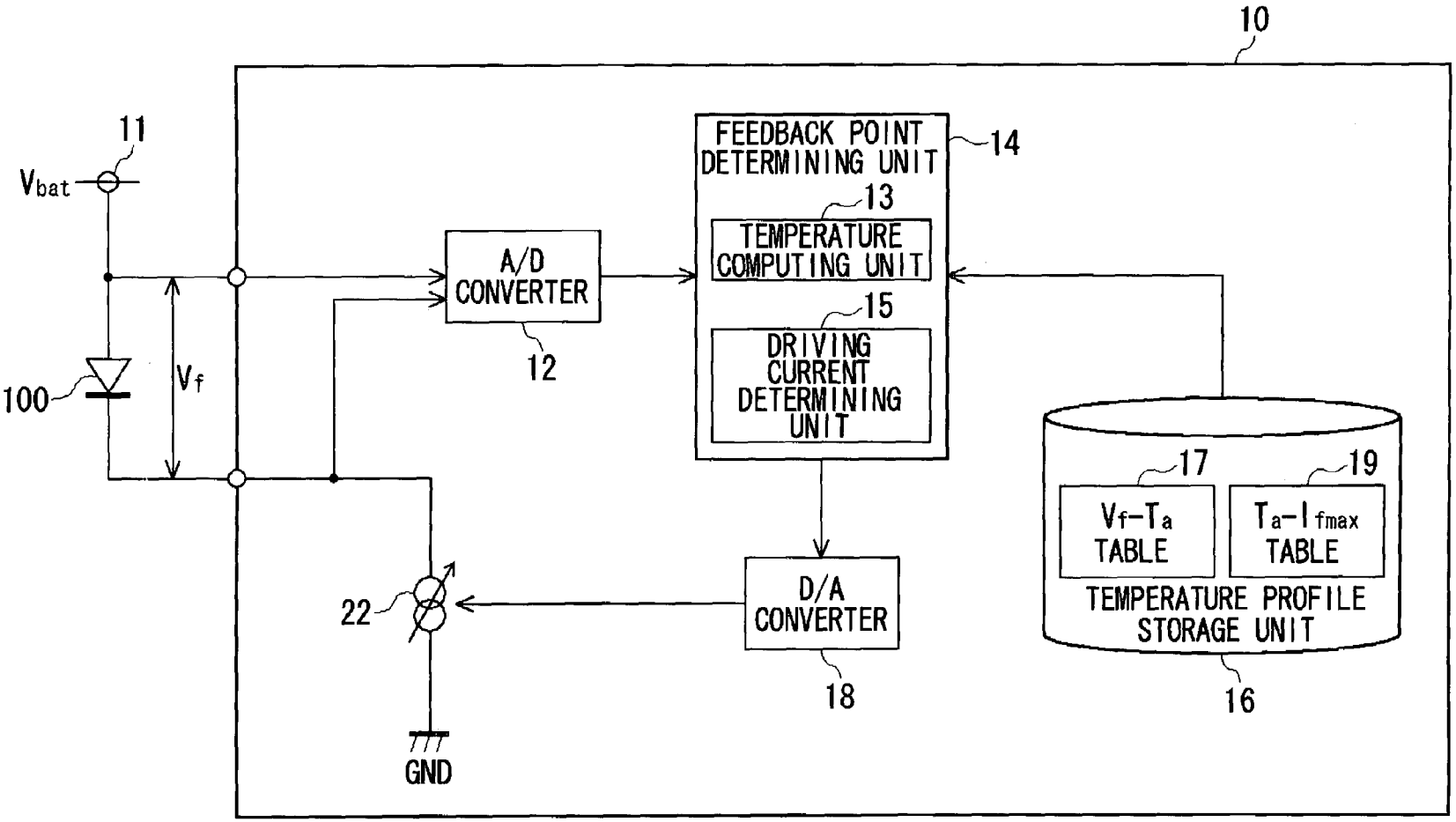
FIG. 1 shows a construction of a light emission control apparatus according to a first embodiment.

FIG. 1 shows a construction of a light-emission control apparatus 10 according to the first embodiment. The light-emission control apparatus 10 detects a forward voltage Vf of an LED element 100 connected as a target of control. The apparatus controls the quantity of light emitted by the LED element 100, by estimating an ambient temperature Ta in accordance with the forward voltage Vf thus detected and determining a feedback point of the driving current to drive the LED element 100 accordingly.

An A/D converter 12 detects the forward voltage Vf of the LED element 100 supplied with a power by a power supply 11, such as a lithium ion battery, with a battery voltage of Vbat. The A/D converter 12 then converts the voltage Vf thus detected into a digital signal and supplies the same to a feedback point determining unit 14.

The feedback point determining unit 14 determines an ambient temperature Ta of the LED element 100 in accordance with the forward voltage Vf supplied from the A/D converter 12 and determines an optimum feedback point of the driving current of the LED element 100 in accordance with the ambient temperature Ta. For computation of the ambient temperature Ta and determination of the feedback point of the driving current, the feedback point determining unit 14 refers to a temperature profile table of the LED element 100 stored in a temperature profile storage unit 16.

The temperature profile storage unit 16 stores a Vf-Ta table 17 mapping between the forward voltage Vf and the ambient temperature Ta of the LED element 100, and a Ta-Ifmax table 19 mapping between the ambient temperature Ta and a maximum tolerated current Ifmax. The Vf-Ta table 17 and the Ta-Ifmax table 19 are prepared in accordance with the temperature characteristics, described later, of the LED element 100. The temperature characteristics of the LED element 100 depend on the type of the LED element 100. Therefore, the Vf-Ta table 17 and the Ta-Ifmax table 19 are prepared for individual LED elements 100 subject to control. Data for the tables are rewritable after being stored in the temperature profile storage unit 16.

A temperature computing unit 13 of the feedback point determining unit 14 determines the ambient temperature Ta from the detected forward voltage Vf, by referring to the Vf-Ta table 17 stored in the temperature profile storage unit 16. The driving current determining unit 15 determines the feedback point of the driving current of the LED element 100 and determines a command value defining the driving current, such that the ambient temperature Ta determined by the temperature computing unit 13 is within a range of ambient temperatures in which the LED element is operable and a desired quantity of light is emitted by the LED element 100.

For example, when the ambient temperature Ta determined by the temperature computing unit 13 is lower than the upper limit of the range in which the LED element 100 is operable and it is necessary to increase the luminance of the LED element 100, the driving current determining unit 15 determines a command value that increases the driving the current. When the ambient temperature Ta approaches the upper limit of the range in which the LED element 100 is operable, the driving current determining unit 15 determines a command value that decreases the driving current. The driving current determining unit 15 may determine the maximum tolerable current Ifmax allowable when the ambient temperature Ta is to be restricted to a predetermined level, by referring to the Ta-Ifmax table 19, and determine a command value so that the driving current of the LED element 100 approaches the maximum tolerable current Ifmax.

The feedback point determining unit 14 converts the command value defining the driving current thus determined into an analog signal via a D/A converter 18, the analog signal being fed to a constant current source 22. The constant current source 22 is connected to the LED element 100 and adjusts the driving current of the LED element 100 in accordance with the command value from the feedback point determining unit 14. As a result of feedback control, the driving current of the LED element 100 is made to converge to a feedback point determined by the feedback point determining unit 14.

Figure 2A:
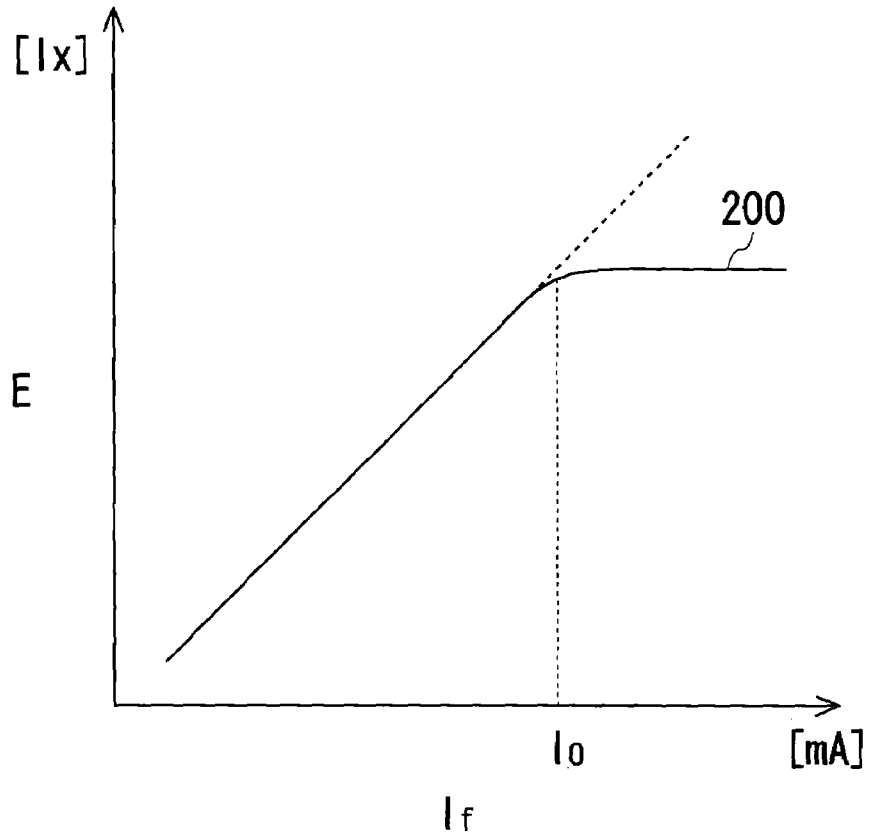
FIG. 2A shows a relationship between a forward current and illuminance of the LED element of FIG. 1.
Figure 2B:
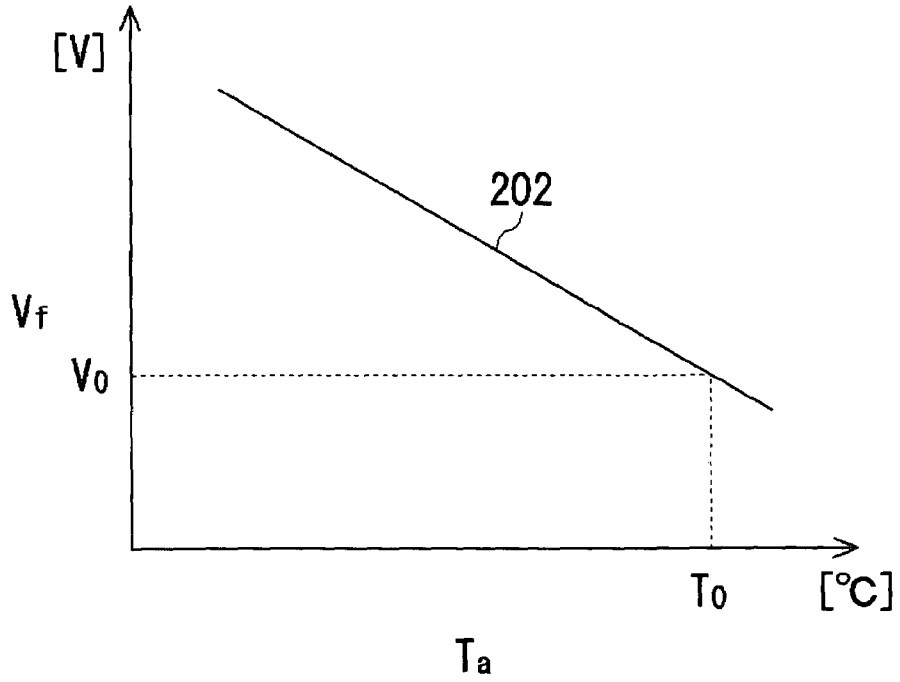
FIG. 2B shows a relationship between the forward voltage and ambient temperature of the LED element of FIG. 1.

FIG. 2A is an optical output vs. forward current graph of the LED element 100. As shown in a graph 200, by increasing the forward current If of the LED element 100, the illuminance E of the LED element 100 is increased substantially linearly. Since the internal temperature of the LED element 100 is increased as the forward current If is increased, however, the light emission efficiency abruptly drops due to heat generation when the forward current If exceeds a level I0. The illuminance E saturates and the LED element 100 is prevented from becoming brighter. FIG. 2B is a forward voltage vs. temperature graph of the LED element. When the ambient temperature Ta is increased while the forward current If is fixed at a certain value, the forward voltage Vf drops substantially linearly, as shown in a graph 202. When the ambient temperature Ta reaches the upper limit T0 of the operable ambient temperature, an abrupt drop in light emission efficiency occurs due to heat generation. Thus, the lower limit V0 of the forward voltage Vf is defined.

Figures 3, 4:
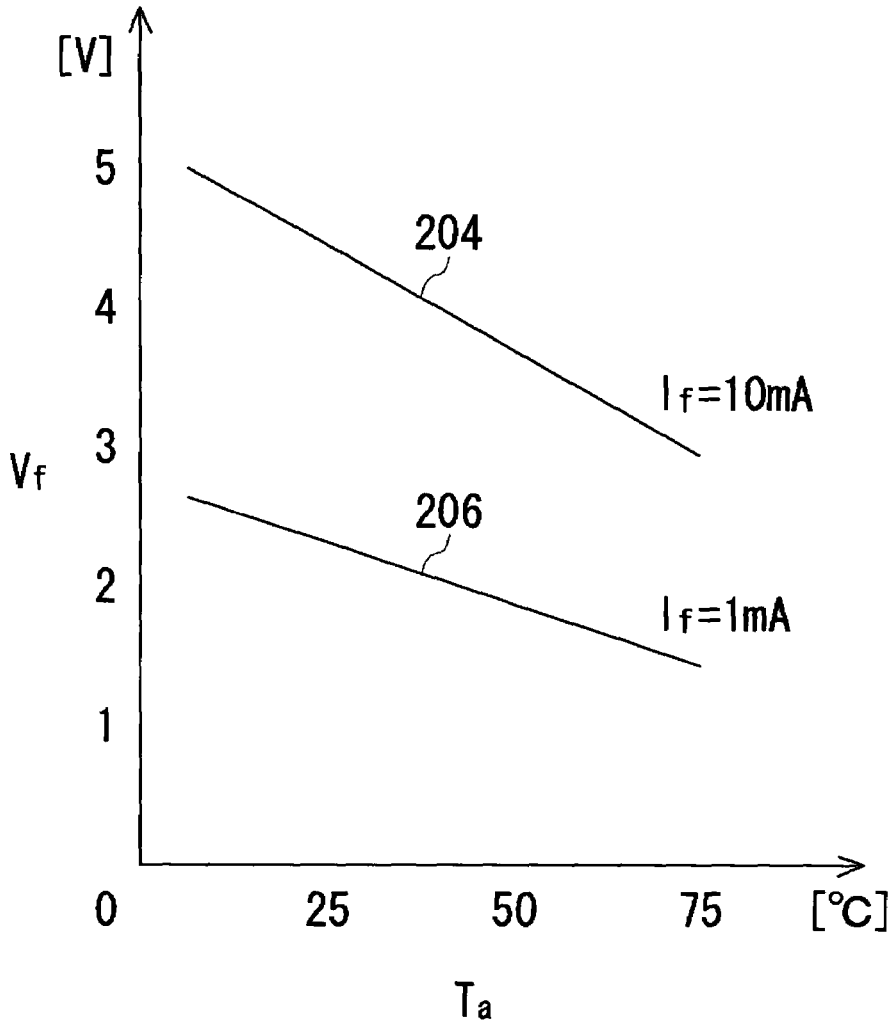
FIG. 3 shows a forward voltage vs. ambient temperature graph of the LED element of FIG. 1 at discrete forward current levels.
FIG. 4 shows a table showing a relationship between forward current and ambient temperature stored in a temperature profile storage unit of FIG. 1.

FIG. 3 shows a forward voltage vs. ambient temperature graph of the LED element 100 at discrete forward current levels. A first graph 204 shows a relationship between the forward voltage Vf and the ambient temperature Ta of the LED element 100 in which the forward current If is 10 mA. A second graph 206 shows a relationship between the forward voltage Vf and the ambient temperature Ta of the LED element 100 in which the forward current If is 1 mA. Given that the forward current If of the LED element 100 is known, these graphs 204 and 206 can be read to show the ambient temperature Ta at the forward voltage Vf.

FIG. 4 shows an example of the Vf-Ta table 17 stored in the temperature profile storage unit 16. In the Vf-Ta table 17, pairs of the forward voltage Vf and the ambient temperature Ta are stored at discrete values of the forward current If, in accordance with the graphs 204 and 206 shown in FIGS. 3A and 3B.

Figures 5, 6:
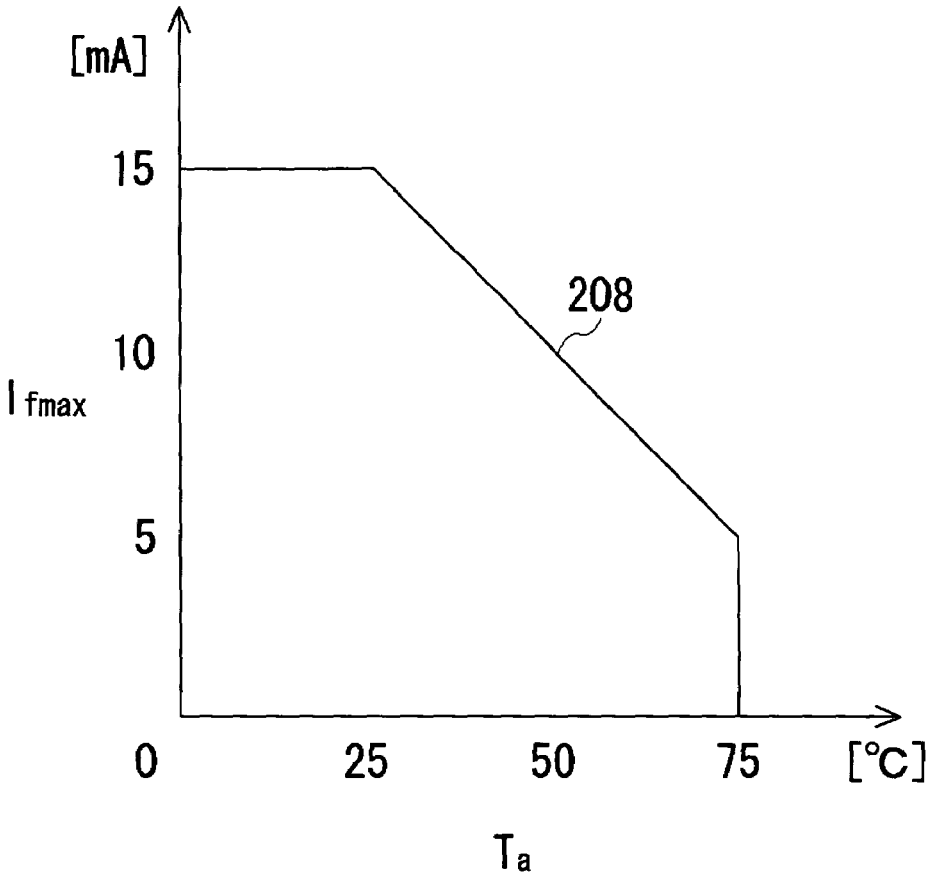
FIG. 5 is an ambient temperature vs. tolerable current graph of the LED element of FIG. 1.
FIG. 6 shows a table showing a relationship between ambient temperature and maximum tolerable current stored in the temperature profile storage unit of FIG. 1.

FIG. 5 is a tolerable current vs. ambient temperature graph of the LED element 100. A graph 208 gives the value of maximum tolerable current Ifmax that can be supplied to the LED element 100 given the ambient temperature Ta within the range in which the LED element 100 is operable. The graph 208 can be read to show the maximum current that can be supplied to the LED element 100 as a driving current, when the ambient temperature Ta is to be controlled at a predetermined level. As shown in the graph 208, the maximum tolerable current Ifmax is 15 mA when the ambient temperature Ta is 25° C. or below. When the ambient temperature Ta is in a range between 25° C. and 75° C., the maximum tolerable current Ifmax is in a range between 15 mA and 5 mA. In this example, the upper limit T0 of the operable ambient temperature is 75° C.

FIG. 6 shows an example of the Ta-Ifmax table 19 stored in the temperature profile storage unit 16. The Ta-Ifmax table 19 stores pairs of the ambient temperature Ta and the maximum tolerable current Ifmax at discrete levels of the forward voltage Vf, in accordance with the graph 208 shown in FIG. 5.

Since the light-emission control apparatus according to the first embodiment is provided with the Vf-Ta table 17 for reading the ambient temperature Ta from the forward voltage Vf at discrete levels of the forward current If in a memory unit, the ambient temperature Ta is determined from the forward voltage Vf of the LED element 100, without measuring the ambient temperature Ta of the LED element 100 directly. In other words, in addition to being a light-emitting element, the LED element 100 of the light-emission control apparatus 10 serves as a temperature sensor for knowing the ambient temperature Ta from the forward voltage Vf. Further, since the light-emission control apparatus 10 determines a feedback point of the driving current within a range in which the LED element 100 is operable, the light emission efficiency of the LED element 100 is prevented from being dropped due to heat generation caused by an excessive current. Thus, the light-emission control apparatus 10 operates as an excessive current limiter.

SECOND EMBODIMENT

Figure 7:
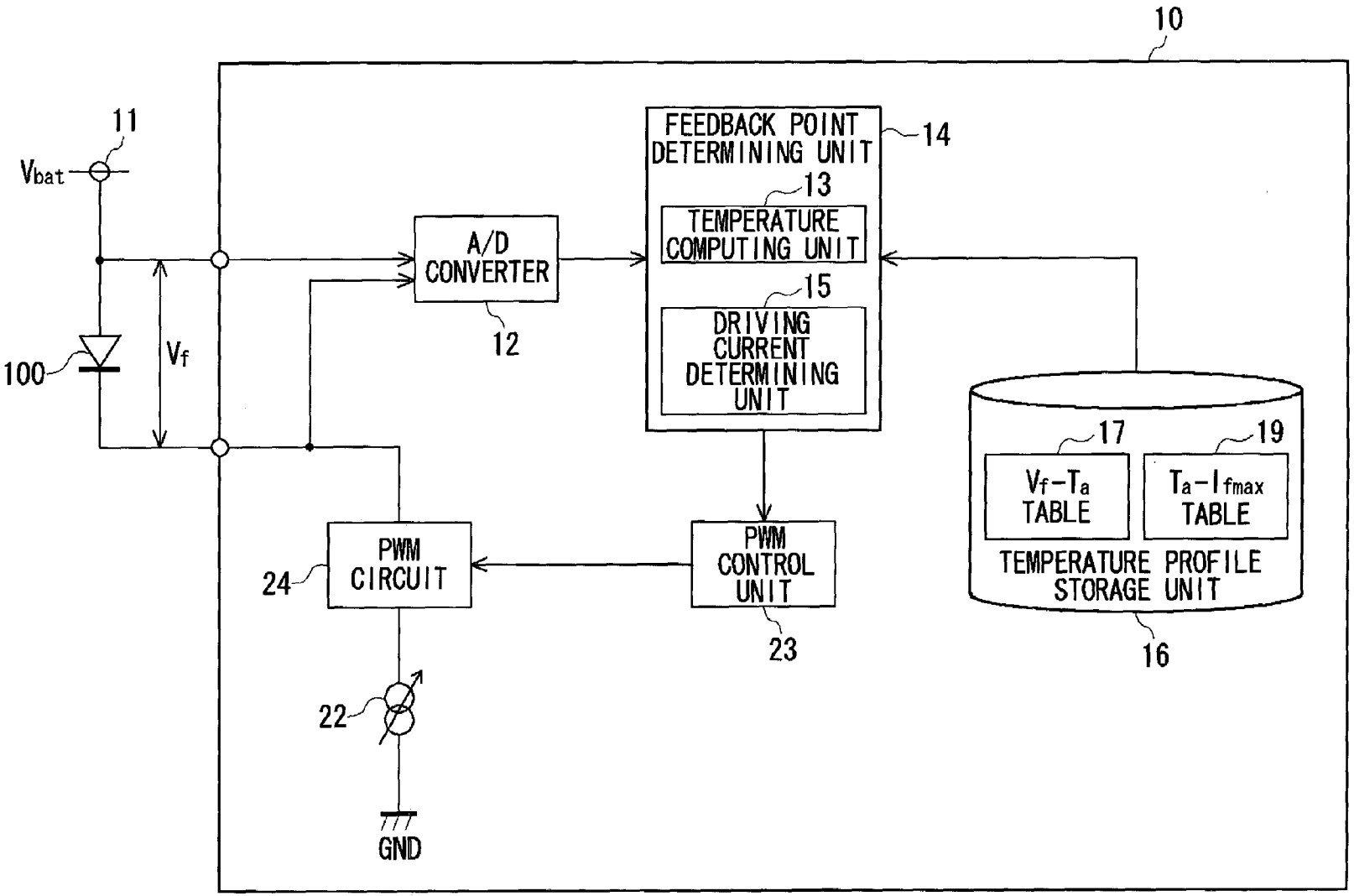
FIG. 7 shows a construction of a light emission control apparatus according to a second embodiment of the present invention.

FIG. 7 shows a construction of a light-emission control apparatus 10 according to the second embodiment. The description of the construction and operation identical to those of the first embodiment is omitted and only the differences from the first embodiment will be described. In the first embodiment, the constant-current source 22 is connected to the LED element 100 so as to drive the LED element 100 by a dc current. In this embodiment, a pulse width modulation (PWM) circuit 24 is provided between the LED element 100 and the constant current source 22 so as to drive the LED element 100 by a pulse current.

The PWM circuit 24 includes a switching element for connecting and disconnecting between the LED element 100 and the constant current source 22, so as to subject the switching element to an on and off control by a pulse signal. When the pulse signal generated by the PWM circuit 24 goes high, the switch element is turned on so that the constant current source 22 supplies the driving current to the LED element 100. When the pulse signal goes low, the switching element is turned off so that the supply of the driving current to the LED element 100 is terminated.

When the duration of high period of the pulse signal generated by the PWM circuit 24 is extended and the duty ratio of the pulse signal is enlarged accordingly, the duration of on period of the switch element is extended so that the driving current supplied to the LED element is increased and the intensity of light emitted by the LED element 100 is increased. When the duty ratio of the pulse signal is reduced, the driving current supplied to the LED element 100 is decreased and the intensity of light emitted by the LED element 100 is decreased. The PWM control unit 23 controls the duty ratio of the pulse signal generated by the PWM circuit 24 in accordance with the command value determined by the driving current determining unit 15 of the feedback point determining unit 14 and defining the driving current. With this, the driving current is accurately adjusted.

THIRD EMBODIMENT

Figure 8:
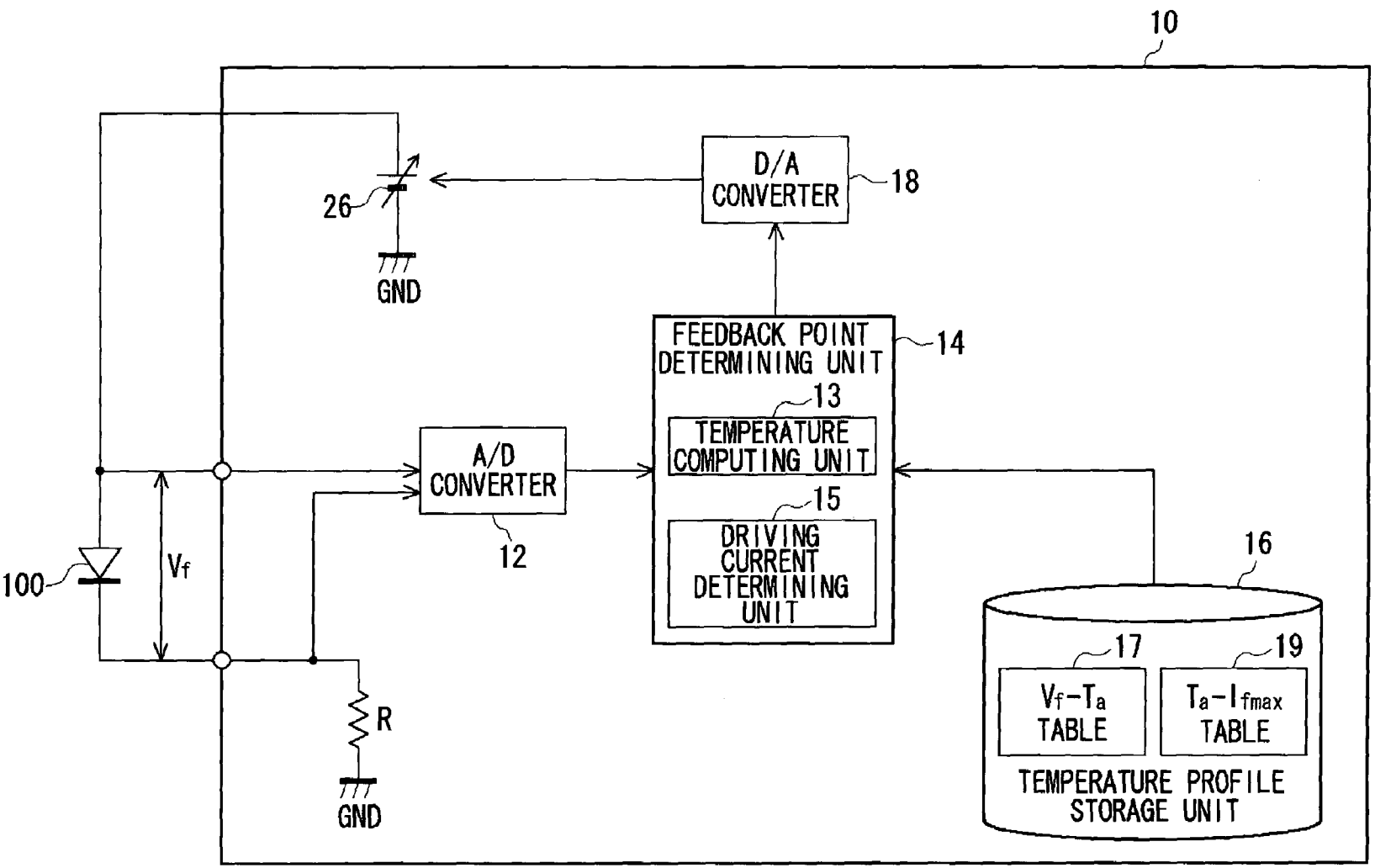
FIG. 8 shows a construction of a light emission control apparatus according to a third embodiment of the present invention.

FIG. 8 shows a construction of the light emission control apparatus 10 according to the third embodiment. In the first embodiment, the constant current source 22 is connected to the LED element 100 and the feedback point determining unit 14 adjusts the driving current supplied from the constant current source 22 to the LED element 100. In this embodiment, a constant voltage source 26 is connected to the LED element 100, and a driving voltage applied from the constant voltage source 26 to the LED element 100 is adjusted by the feedback point determining unit 14 so that the driving current supplied to the LED element 100 is controlled accordingly.

FOURTH EMBODIMENT

Figure 9:
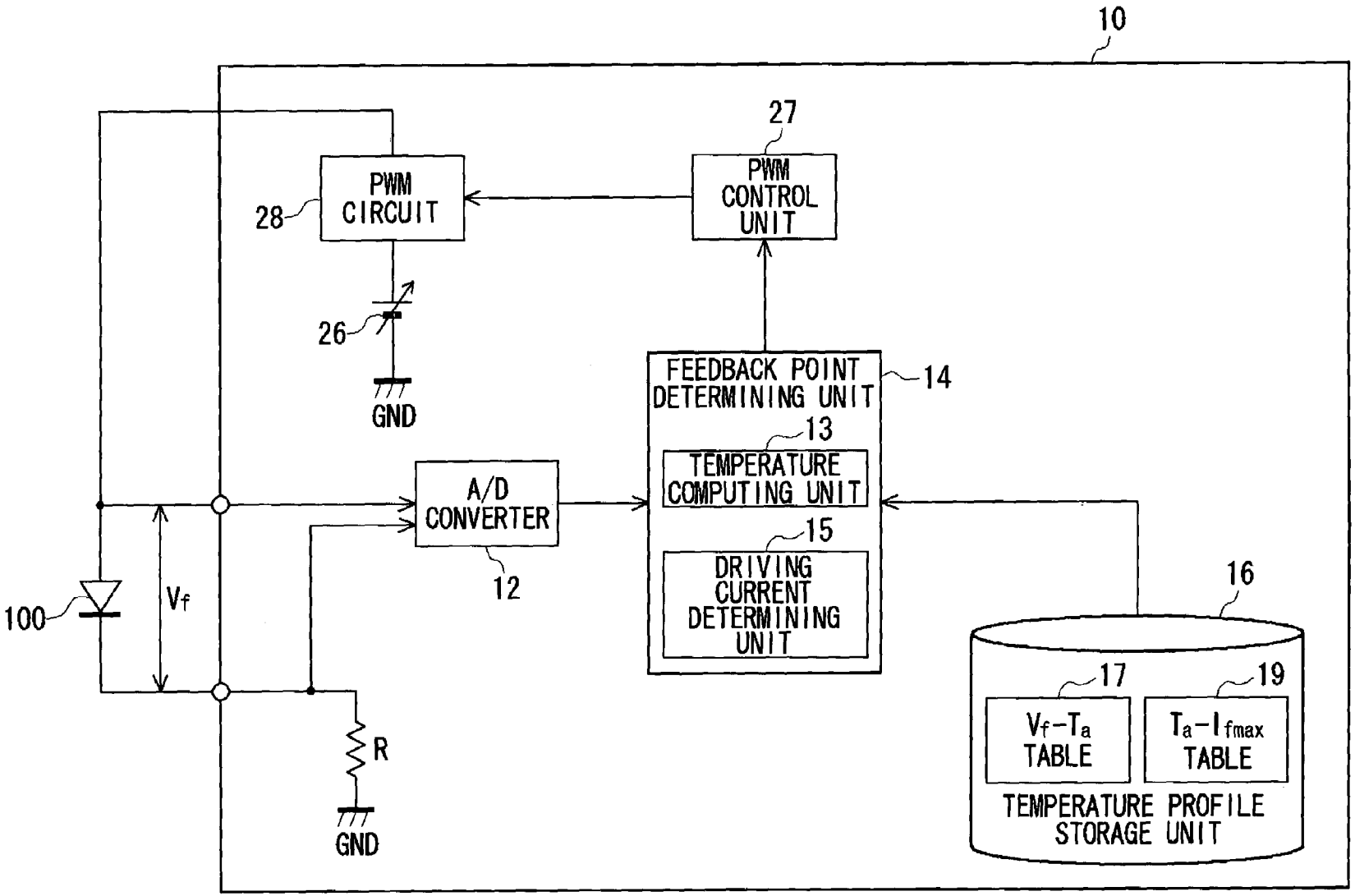
FIG. 9 shows a construction of a light emission control apparatus according to a forth embodiment of the present invention.

FIG. 9 shows a construction of the light emission control apparatus 10 according to the fourth embodiment. In this embodiment, a PWM circuit 28 is provided between the LED element 100 and the constant voltage source 26. The driving current supplied to the LED element 100 is adjusted by subjecting a switch element connecting or disconnecting the LED element 100 and the constant voltage source 26 to on and off control according to the pulse width modulation scheme. The PWM control unit 27 adjusts the duty ratio of the pulse signal generated by the PWM circuit 28 in accordance with the command value determined by the driving current determining unit 15 of the feedback point determining unit 14 and defining the driving current.

Given above is a description based on the embodiments of the present invention. The embodiment of the present invention is only illustrative in nature and it will be obvious to those skilled in the art that various variations in constituting elements and processes are possible within the scope of the present invention.

In the embodiments described, primary importance is attached to the luminance of the LED element 100. In the described type of control, the driving current is increased in level until the limit of light emission efficiency due to heat generation of the LED element 100 is reached, in order to raise the luminance. Alternatively, the driving current may be decreased at the cost of decreasing the luminance, in order to prevent a battery, such as a lithium ion battery, from being exhausted. In controlling light emitting elements provided in portable appliances such as a portable telephone or a personal digital assistant (PDA), an important factor to be considered is saving on power consumption of a battery. In a situation where the ambient temperature Ta is approaching the upper limit of the operable ambient temperature, the driving current may be controlled to be decreased at the cost of decreasing the luminance, because, in this situation, the quantity of emitted light saturates and is not easily increased even if the driving current is increased.

In the embodiments, an LED element is given as an example of a light emitting element connected to the light emission control apparatus 10. Alternatively, of course, the light emitting element may be other element such as an organic electro-luminescence (EL) element.

What is claimed is:

1. A light emission control apparatus comprising:

a voltage-temperature profile storage unit storing a table mapping forward voltages to ambient temperatures at discrete levels of the forward currents, showing characteristics of the ambient temperature with respect to the forward voltage of a light emitting element;

a forward voltage detecting unit detecting the forward voltage of the light emitting element subject to control;

a temperature computing unit configured to determine the ambient temperature from the detected forward voltage of the light emitting element by referring to the table mapping the forward voltages of the light emitting element to the ambient temperatures;

a driving current determining unit determining a command value defining a driving current to drive the light emitting element in accordance with the ambient temperature determined by said temperature computing unit; and a driving current control unit controlling the driving current to drive the light emitting element in accordance with the command value thus determined.

2. The light emission control apparatus according to claim 1, wherein said driving current determining unit determines a feedback point of the driving current so that the ambient temperature determined by said temperature computing unit is within a range of temperatures in which the light emitting element is operable.

3. The light emission control apparatus according to claim 2, wherein said driving current control unit includes a constant current source supplying a constant current to the light emitting element, and a pulse width modulation circuit subjecting a switch element connecting or disconnecting the light emitting element and the constant current source to on and off control according to pulse width modulation, and wherein said driving current control unit controls the driving current by controlling a duty ratio of a pulse signal in accordance with the command value.

4. The light emission control apparatus according to claim 2, wherein said driving current control unit includes a constant voltage source applying a constant voltage to the light emitting element, and a pulse width modulation circuit subjecting a switch element connecting or disconnecting the light emitting element and the constant voltage source to on and off control according to pulse width modulation, and wherein said driving current control unit controls the driving current by controlling a duty ratio of a pulse signal in accordance with the command value.

5. An electronic information appliance using the light emission control apparatus according to claim 2 in a light emitting source.

6. The light emission control apparatus according to claim 1, wherein said driving current control unit includes a constant current source supplying a constant current to the light emitting element, and controls the driving current by adjusting a current supplied from the constant current source to the light emitting element.

7. The light emission control apparatus according to claim 1, wherein said driving current control unit includes a constant voltage source applying a constant voltage to the light emitting element and controls the driving current by adjusting a voltage applied by the constant voltage source to the light emitting element.

8. The light emission control apparatus according to claim 1, wherein said driving current control unit includes a constant current source supplying a constant current to the light emitting element, and a pulse width modulation circuit subjecting a switch element connecting or disconnecting the light emitting element and the constant current source to on and off control according to pulse width modulation, and wherein said driving current control unit controls the driving current by controlling a duty ratio of a pulse signal in accordance with the command value.

9. The light emission control apparatus according to claim 1, wherein said driving current control unit includes a constant voltage source applying a constant voltage to the light emitting element, and a pulse width modulation circuit subjecting a switch element connecting or disconnecting the light emitting element and the constant voltage source to on and off control according to pulse width modulation, and wherein said driving current control unit controls the driving current by controlling a duty ratio of a pulse signal in accordance with the command value.

10. An electronic information appliance using the light emission control apparatus according to claim 1 in a light emitting source.

11. A light emission control apparatus comprising:

a temperature-current profile storage unit storing a table mapping the ambient temperatures to tolerable currents showing characteristics of the ambient temperature with respect to the tolerable current of the light emitting element;

a temperature determining unit determining the ambient temperatures;

a driving current determining unit determining a command value defining a maximum tolerable current of the light emitting element allowable when the ambient temperature is to be restricted to a predetermined level, by referring to the table mapping the ambient temperatures to the tolerable currents; and a driving current control unit controlling the driving current to drive the light emitting element in accordance with the command value thus determined.

12. The light emission control apparatus according to claim 11, wherein said driving current control unit includes a constant current source supplying a constant current to the light emitting element, and a pulse width modulation circuit subjecting a switch element connecting or disconnecting the light emitting element and the constant current source to on and off control according to pulse width modulation, and wherein said driving current control unit controls the driving current by controlling a duty ratio of a pulse signal in accordance with the command value.

13. The light emission control apparatus according to claim 11, wherein said driving current control unit includes a constant voltage source applying a constant voltage to the light emitting element, and a pulse width modulation circuit subjecting a switch element connecting or disconnecting the light emitting element and the constant voltage source to on and off control according to pulse width modulation, and wherein said driving current control unit controls the driving current by controlling a duty ratio of a pulse signal in accordance with the command value.

14. An electronic information appliance using the light emission control apparatus according to claim 11 in a light emitting source.

15. The light emission control apparatus according to claim 11, wherein said temperature determining unit includes:

a voltage-temperature profile storage unit storing a table mapping forward voltages to ambient temperatures at discrete levels of the forward currents, showing characteristics of the ambient temperature with respect to the forward voltage of a light emitting element;

a forward voltage detecting unit detecting the forward voltage of the light emitting element subject to control; and a temperature computing unit determining the ambient temperature from the detected forward voltage, by referring to the table mapping the forward voltages to the ambient temperatures.

16. A light emission control method comprising:

detecting a forward voltage of a light emitting element;

determining an ambient temperature of the light emitting element from the detected forward voltage, by referring to a table mapping the forward voltages to the ambient temperatures showing characteristics of the ambient temperature with respect to the forward voltage of a light emitting element; and determining a feedback point of a driving current to drive the light emitting element in accordance with the ambient temperature thus determined so as to control the driving current to drive the light emitting element accordingly, wherein the determining the feedback point of the driving current to drive the light emitting element and controlling the driving current to drive the light emitting element accordingly includes referring to a table mapping the ambient temperatures to tolerable currents showing characteristics of the ambient temperature with respect to the tolerable current of the light emitting element, and wherein a maximum tolerable current of the light emitting element allowable when the ambient temperature is to be restricted to a predetermined level is determined by referring to the table mapping the ambient temperatures to the tolerable currents, and the command value defining the driving current is determined in accordance with the maximum tolerable current.

17. The light emission control method according to claim 16, wherein the feedback point of the driving current is determined so that the ambient temperature is within a range of temperatures in which the light emitting element is operable.

18. The light emission control method according to claim 16, wherein the determining the feedback point of the driving current to drive the light emitting element and controlling the driving current to drive the light emitting element accordingly controls the driving current by subjecting a constant current source supplying a constant current to the light emitting element to pulse width modulation and adjusting a pulse duty ratio in accordance with the command value.

19. The light emission control method according to claim 16, wherein the determining the feedback point of the driving current to drive the light emitting element and controlling the driving current to drive the light emitting element accordingly controls the driving current by subjecting a constant voltage source applying a constant voltage to the light emitting element to pulse width modulation and adjusting a pulse duty ratio in accordance with the command value.

* * * * *